US010548413B2

(12) United States Patent
Smith

(10) Patent No.: US 10,548,413 B2
(45) Date of Patent: Feb. 4, 2020

(54) INFLATABLE CHILD SAFETY BED

(71) Applicant: Jonathan Russell Smith, Warsaw, OH (US)

(72) Inventor: Jonathan Russell Smith, Warsaw, OH (US)

( * ) Notice: Subject to any disclaimer, the term of this patent is extended or adjusted under 35 U.S.C. 154(b) by 444 days.

(21) Appl. No.: 15/089,434

(22) Filed: Apr. 1, 2016

(65) Prior Publication Data

US 2016/0286982 A1 Oct. 6, 2016

Related U.S. Application Data

(60) Provisional application No. 62/141,555, filed on Apr. 1, 2015.

(51) Int. Cl.

| | |
|---|---|
| ***A47D 15/00*** | (2006.01) |
| ***A47D 9/00*** | (2006.01) |
| ***A47D 13/06*** | (2006.01) |
| ***E04H 15/20*** | (2006.01) |
| ***E04H 15/02*** | (2006.01) |

(52) U.S. Cl.

CPC ..... *A47D 15/008* (2013.01); *A47D 9/00* (2013.01); *A47D 13/06* (2013.01); *A47D 13/063* (2013.01); *A47D 15/001* (2013.01); *E04H 15/02* (2013.01); *E04H 15/20* (2013.01)

(58) Field of Classification Search

CPC .... A47D 15/00; A47D 15/001; A47D 15/005; A47D 15/008; A47D 9/00; A47D 13/02; A47D 13/06; A47D 13/063; A47C 29/00; E04H 15/00; E04H 15/02; E04H 15/20; E04H 2015/208

See application file for complete search history.

(56) References Cited

U.S. PATENT DOCUMENTS

| | | | | | |
|---|---|---|---|---|---|
| 3,457,684 | A | * | 7/1969 | Wood, Jr. | E04H 15/20 52/2.21 |
| 3,619,825 | A | * | 11/1971 | Taub | A47D 7/002 206/522 |
| 3,877,090 | A | * | 4/1975 | Schutz | A47D 15/008 5/93.1 |
| 4,000,585 | A | * | 1/1977 | Denaro | E04H 15/20 52/2.17 |
| 4,104,750 | A | * | 8/1978 | Kelter | A47D 9/005 5/703 |
| 4,590,956 | A | * | 5/1986 | Griesenbeck | E04H 15/40 135/116 |
| 4,607,655 | A | * | 8/1986 | Wagner | E04H 15/20 135/116 |

(Continued)

*Primary Examiner* — David R Hare

(74) *Attorney, Agent, or Firm* — Miracle IP; Bryce D. Miracle

(57) ABSTRACT

An inflatable child safety bed for providing safe, soft and comfortable place for special needs children to be safely secured for bedtime purposes. Moreover, the inflatable nature of the bed provides a protective barrier between them and the outside environment. The inflatable child safety bed generally comprises an upper inflatable structure adapted to be secured to a bed having a mattress. In other versions, the inflatable child safety bed further includes a removable attachable inflatable bottom mattress adapted to couple with the upper inflatable structure in order to provide a flooring to the interior space.

4 Claims, 4 Drawing Sheets

(56) References Cited

U.S. PATENT DOCUMENTS 4,625,468 A * 12/1986 Hampel ..... E04H 9/10 109/1 S
4,766,918 A * 8/1988 Odekirk ..... E04H 15/02 114/345
4,827,542 A * 5/1989 Kurtenbach ..... A47D 7/04 5/93.1
4,852,598 A * 8/1989 Griesenbeck ..... E04H 15/40 135/137
5,007,212 A * 4/1991 Fritts ..... E04H 15/20 135/116
5,341,530 A * 8/1994 Ward ..... A47D 9/005 383/18
5,555,679 A * 9/1996 Scherba ..... E04H 15/20 135/126
5,570,544 A * 11/1996 Hale ..... E04H 15/20 52/2.11
5,642,750 A * 7/1997 Brown ..... E04H 15/20 135/116
5,778,915 A * 7/1998 Zheng ..... A63B 9/00 135/119
5,930,854 A * 8/1999 O'Neill ..... A47D 13/063 135/135
5,970,661 A * 10/1999 Bishop ..... E04H 15/006 135/125
D469,496 S * 1/2003 Schur ..... D21/834
6,550,083 B1 * 4/2003 LaMantia ..... A47C 29/003 135/96
6,722,084 B2 * 4/2004 Berman ..... E04H 15/006 135/120.1
6,862,757 B2 * 3/2005 Andriunas ..... A47D 7/04 5/93.2
7,047,991 B2 * 5/2006 Kline ..... A47C 21/08 135/96
7,117,552 B2 * 10/2006 Hoffman ..... A47D 13/06 5/655
7,178,483 B2 * 2/2007 Wu ..... A01K 1/033 119/498
7,225,484 B1 * 6/2007 Ortiz ..... A47D 15/008 128/872
7,448,345 B1 * 11/2008 O'Donnell ..... A01K 1/0272 119/28.5
8,316,482 B1 * 11/2012 Martin, III ..... A47C 29/00 5/655
8,328,594 B2 * 12/2012 Hall ..... A47D 13/06 446/220
8,893,661 B2 * 11/2014 Pietra ..... F16M 13/02 119/28.5
8,955,174 B1 * 2/2015 Lawlor ..... A47D 13/063 5/93.1
9,554,659 B2 * 1/2017 Doering ..... A47D 7/04
2003/0196263 A1 * 10/2003 Hardy ..... A47D 7/002 5/93.1
2005/0172400 A1 * 8/2005 Hardy ..... A47D 9/005 5/93.1
2007/0051052 A1 * 3/2007 Toledo ..... A47F 3/002 52/23
2007/0214576 A1 * 9/2007 Espenshade ..... A47D 13/063 5/723
2010/0186169 A1 * 7/2010 Kelly ..... A47D 15/008 5/655
2010/0235979 A1 * 9/2010 Pesta ..... E04H 4/0025 4/499
2013/0000036 A1 * 1/2013 Wood Greeney ..... A47D 9/005 5/93.1
2013/0255041 A1 * 10/2013 Weinstein ..... A44B 19/301 24/387

* cited by examiner

INFLATABLE CHILD SAFETY BED

This application is based upon and claims the priority filing date of the previously filed, U.S. Provisional patent application entitled "APPARATUS FOR INFANT BEDDING" filed Apr. 1, 2015, Ser. No. 62/141,555, the entire disclosure of which is hereby incorporated herein by reference.

BACKGROUND

This disclosure relates to a child bed or crib, particularly a bed tailored for special needs children while traveling outside the home or place of care.

It is well known that over 18% of American children under 18 have some type of special needs which require special care. Special Needs Children may be physically, developmental, behaviorally, and/or sensory impaired. These types of special needs can include among others ranging from Muscular Dystrophy, Multiple Sclerosis, Chronic Asthma Epilepsy, Down Syndrome, Autism, Dyslexia, Attention Deficit Disorder, Blind, and/or Deaf.

Children affected with these type of disabilities, require a broad range of support and special help that meets their individual needs—each requiring a different amount attention and care.

In particular, traveling with children with special needs can be very difficult to manage from the perspective of both the child and the caretaker. Children with special needs require all of the same care in which they would find at their home place of care. Typically, places such as hotels and other places away from the child's home are not outfitted or suited with proper equipment and tools in order to properly manage and care for the child's needs while traveling. Existing tools and equipment are designed for more permanent placement at the child's home and not designed to be favorable for purposes of travel, particular the child's bedding needs.

Current special needs bedding depending on the child's conditions and needs can be very expensive, cumbersome, are made from a hard framed materials likely to be permanent to the child's home—not adapted for travel and overnight stay at places beyond the home or place of care. This severely limits the ability for the child to travel outside of the home or place of care—reducing the quality of life for the child. Moreover, special needs children that are prone to seizures require special bedding that is safe, soft and configured to prevent injury.

For the foregoing reasons, what is needed is a bedding adapted for use by Special Needs Children which is portable, favorable for traveling purposes beyond the child's home or place of care, and overall safe for the child.

SUMMARY

For the foregoing reasons, what is needed is an inflatable child safety bed assembly which provides a safe, ergonomical, travel friendly, bedding suited for special needs children, particular while traveling outside of the child's home place of care. The bed is inflatable in nature and thus while in the deflated state is light, foldable, compact and easily stored and transported. On the other hand, while the bed is inflated, the bed assembly provides a safe, soft and comfortable place for special needs children to be safely secured for bedtime purposes. Moreover, the inflatable nature of the bed provides a protective barrier between them and the outside environment, particularly relevant in cases of children suffering from seizures or other forms of uncontrollable outbursts.

In accordance with the invention, an inflatable child safety bed is provided. A version of the invention is utilized in conjunction with everyday existing bed structures. The version generally comprises: (a) an upper inflatable structure defining an interior space comprising: (i) a first wall, a second wall, and opposing end walls when inflated defining a triangular tent closed at each end having a floorless bottom, wherein each wall includes a base portion and an inflation valve, each wall being separately inflatable; and (ii) wherein at least one of the first wall, second wall, and opposing end walls having a zipper-closable flap having a zipper located at the perimeter thereof which can be opened or closed to provide ingress and egress to the interior space, the zipper-closable flap made of a breathable mesh netting; and (b) at least one removably attachable length adjustable strap connecting the base portion of the first wall and the base portion of the opposing second wall, wherein length adjustable strap is adapted to secure the upper inflatable structure to a bed having a mattress by extending about the mattress body and connecting with opposite sides of the upper inflatable structure, whereby length adjustable strap can be adjusted in order to tighten down the upper inflatable structure to the bed having a mattress.

In a particular version of the invention, there are two laterally disposed length adjustable straps having a first end and a second end which extend about the mattress body in parallel attaching the base portion of the first wall and the corresponding base portion of the opposing second wall, each strap first end attaching near lateral ends and near equidistant from the center of the base portion of first wall and each strap second end attaching near corresponding lateral ends and equidistant from the center of the base portion of the corresponding opposing second wall, thereby providing improved stability of the upper inflatable structure while attached to the bed having a mattress.

In a second version of the invention the above described upper inflatable structure is utilized in conjunction with a removably attachable inflatable bottom mattress as opposed to the length adjustable straps providing connection to existing bedding structures. The second version generally comprises (a) an upper inflatable structure defining an interior space comprising: (i) first wall, a second wall, and opposing end walls when inflated defining a triangular tent closed at each end having a floorless bottom, wherein each wall includes a base portion and an inflation valve, each wall being separately inflatable; and (ii) wherein at least one of the first wall, second wall, and opposing end walls having a zipper-closable flap having a zipper located at the perimeter thereof which can be opened or closed to provide ingress and egress to the interior space, the zipper-closable flap made of a breathable mesh netting; and (b) a removable attachable inflatable bottom mattress adapted to couple with the floorless bottom of the upper inflatable structure in order to provide a flooring to the interior space, the inflatable bottom mattress having a top floor surface, a first side, a second side, opposing end sides, and an inflation valve, wherein the inflatable bottom mattress is separately inflatable; and (c) a means for removably attaching the upper inflatable structure with the inflatable bottom mattress.

Still other benefits and advantages of the invention will become apparent to those skilled in the art to which it pertains upon a reading and understanding of the following detailed specification.

BRIEF DESCRIPTION OF THE DRAWINGS

These and other features, aspects, and advantages of the present invention will become better understood with regard to the following description, appended claims, and accompanying drawings where:

DESCRIPTION

Figure 1:
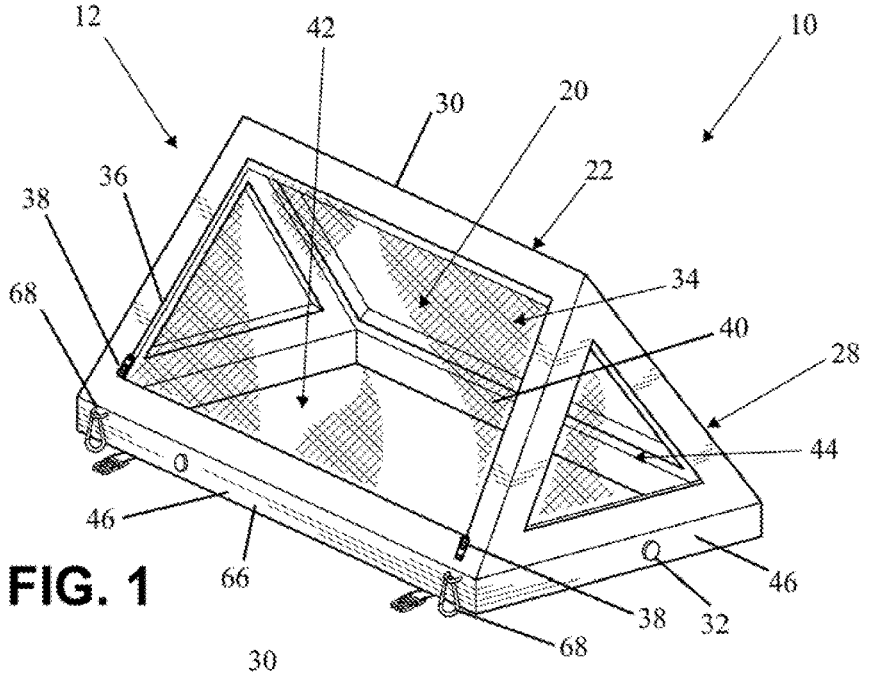
FIG. 1 is a front perspective view of a version of the present invention.
Figure 2:
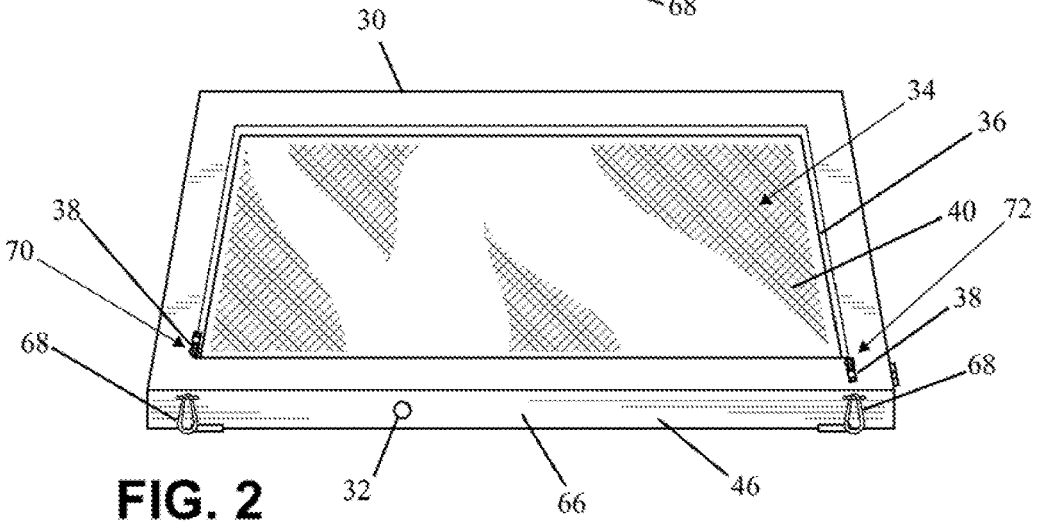
FIG. 2 is a front elevation view of the version shown in FIG. 1.
Figure 3:
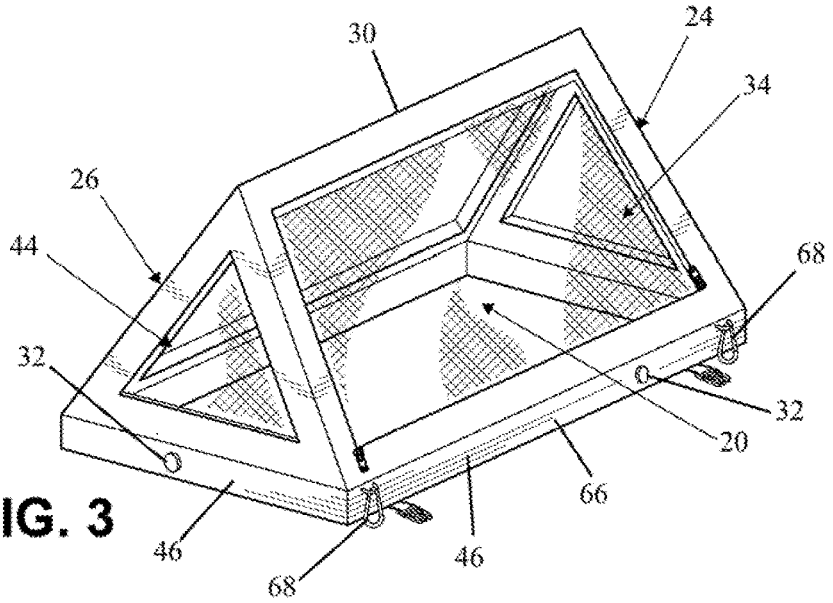
FIG. 3 is a rear perspective view of the version shown in FIG. 1.

Referring now to the drawings wherein the showings are only for purposes of illustrating a preferred version of the invention and not for purposes of limiting the same.

The following detailed description is of the best currently contemplated modes of carrying out exemplary versions of the invention. The description is not to be taken in the limiting sense, but is made merely for the purpose of illustrating the general principles of the invention, since the scope of the invention is best defined by the appended claims.

Various inventive features are described below that can each be used independently of one another or in combination with other features.

The invention relates to an inflatable child safety bed assembly which is utilized to provide a safe, ergonomical, travel friendly, bedding tailored for special needs children, particular while traveling outside of the child's home place of care. The bed is inflatable in nature and thus while in the deflated state is light, foldable, compact and easily stored and transported. On the other hand, while the bed is inflated, the safety bed assembly provides a safe, soft and comfortable place for special needs children to be safely secured for bed time purposes and other activities. Moreover, the inflatable nature of the bed provides a protective barrier between them and the outside environment, most relevant in cases of children suffering from seizures or forms of uncontrollable outbursts.

Figure 4:
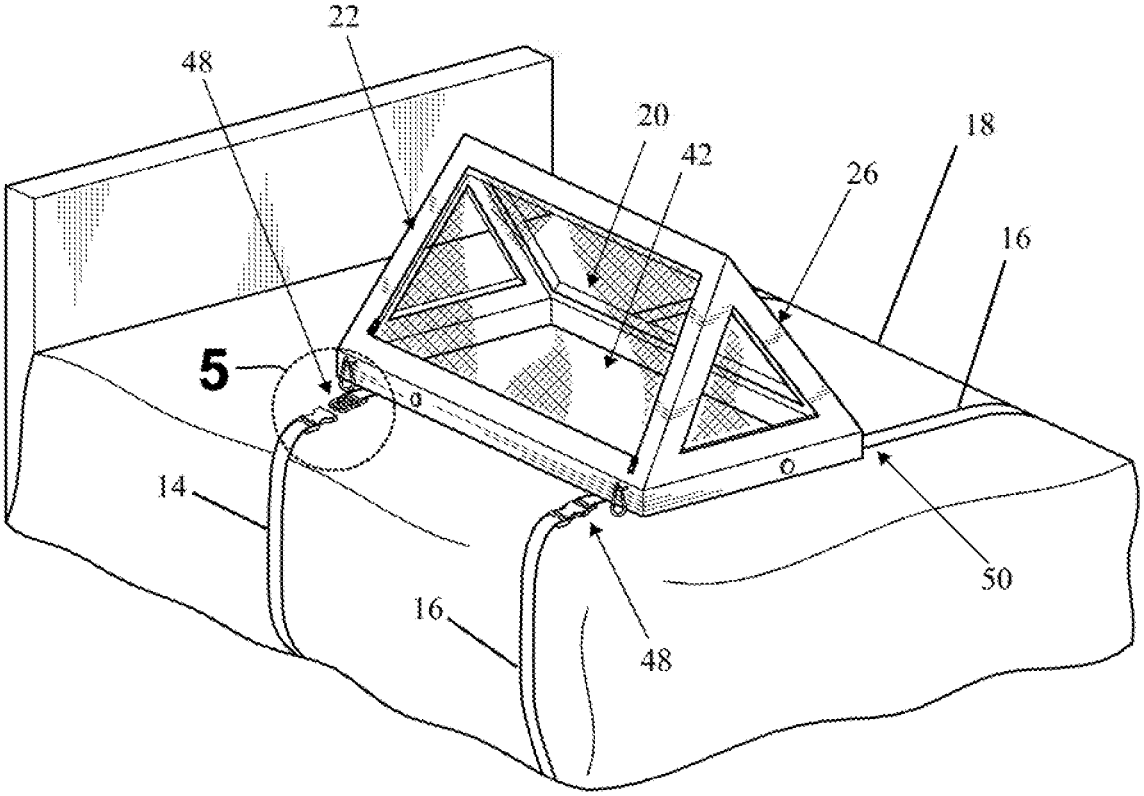
FIG. 4 is an illustrative perspective view showing the version as shown in FIG. 1 adapted to an existing bedding structure.

With reference now to the drawings, and in particular to FIG. 1-FIG. 5 thereof, a new inflatable child safety bed assembly embodying the principles and concepts of the present invention and generally designated by the reference numeral 10 will be disclosed. In a first version, the bed assembly 10 generally comprises an upper inflatable structure 12 and one or more removably attachable length adjustable straps 14, 16 for securing the upper inflatable structure 12 to an existing bedding structure 18 as best illustrated by FIG. 4.

In the version, the upper inflatable structure 12 defines an interior space 20 wherein the child is maintained during bedtime and other activities. The upper inflatable structure 12 generally comprises a first wall 22, a second wall 24, and opposing end walls 26, 28. When inflated, the tops of both the first and second walls 22, 24 form an elongated top ridge 30 providing a triangular or tent-like frame work of the upper inflatable structure 12. The upper inflatable structure 12 is enclosed at each end by opposing end walls 26, 28 forming a triangular cross section or tent-like structure having a floorless bottom 42—best illustrated by FIG. 4. It will be noted that the triangular cross section configuration ensures that the child's center of gravity is maintained within safe parameters—ensuring that the bed assembly 10 is stable and not likely to tip over due to limiting the range of the child's movement within the interior space 20. This configuration limits the child's ability to move high and away from the center of the interior space 20.

In the version 10, each wall including the first wall 22, second wall 24, and the opposing end walls 26, 28 are independently and separately inflatable via their requisite inflation valves 32. Providing separately inflatable air chambers separately within each wall ensures that during an air leak, the leak will only affect one wall as opposed to all of the walls, maintaining a sufficient structure in order to provide adequate interior space 20. Utilizing continuous air chambers connecting all of the walls would be problematic during a leak, the entire inflatable structure 12 would deflate and smother the child encompassed within. The valves 32 can be positioned anywhere that is proficient to easily inflate or deflate each wall.

As best illustrated by FIG. 7-FIG. 10, at least one of the walls includes a zipper-closable flap 34. The zipper-closable flap 34 is configured to utilize a zipper 38 to zip and unzip about the perimeter 36 or zipper path of travel as known in the art. The zipper-closable flap 34 can be opened or closed via the zipper 38 providing ingress and egress of the child to and from the interior space 20. The zipper-closable flap 34 can be made of any flexible material as is known in the art. Preferably, the zipper-closable flap 34 is made from a breathable netting 40 or nylon mesh as is known in the art. This ensures that the child is provided with adequate fresh air from exterior the bed assembly 10. In the version, both the first wall 22 and the second wall 24 provide a zipper-closable flap 34. Moreover, in the version each of the opposing end walls 26, 28 include a breathable netting window 44. The breathable netting windows 44 provide a breathable material further ensuring fresh air into the interior space 20 of the bed assembly 10.

As illustrated in the first version, each of the first wall 22, second wall 24, and opposing end walls 26, 28 include a base portion 46. Further, as best illustrated by FIG. 4, one or more removably attachable length adjustable straps 14, 16 are provided for securing the upper inflatable structure 12 to an existing bedding structure 18. Each strap 14, 16 comprises a first end 48 and a second end 50. Each first end 48 of the straps 14, 16 are connected to the base portion 46 of the first wall 22 extending about the existing bedding structure 18 and the second ends 50 of each strap 14, 16 are connected to the opposing base portion 46 of the second wall 24. The straps 14, 16 are length adjustable as known in the art. Thus, the length of each strap 14, 16 can be adjusted in accordance with securing the upper inflatable structure 12 securely to the existing bedding structure 18. Thus, once the upper inflatable structure 12 is affixed to the bedding structure 18, the bedding structure 18 provides a flooring within the upper inflatable structure 12 and to the interior space 20. Preferably, each length adjustable strap 14, 16 first end 48 is attached near the lateral ends and equidistant from the center 66 of the base portion 46 of the first wall 22. Likewise, each length adjustable strap 14, 16 second end 50 attaching near corresponding lateral ends and equidistant from the center 66 of the base portion 46 of the corresponding opposing second wall 24. This configuration is ideally balanced to provide improved stability of the upper inflatable structure while attached to the existing bedding structure—thereby inhibiting movement.

Figure 5:
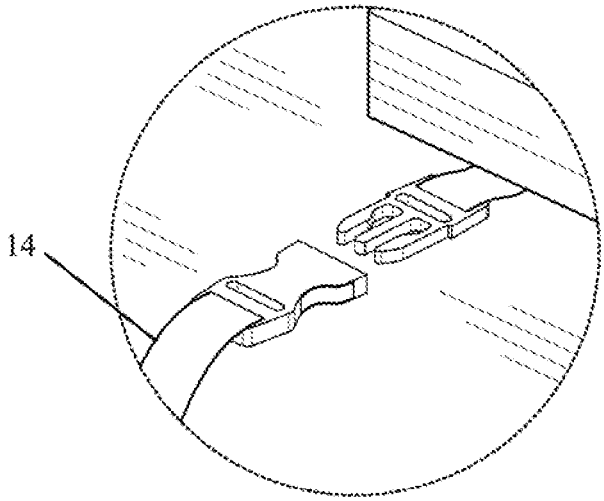
FIG. 5 is an up-close view taken from FIG. 4.

Preferably and as best illustrated by FIG. 5, the ends 48, 50 of each strap 14, 16 can be secured to the base portions 46 via a buckle type fastener 52. This type of fastener is both secure and quick to attach and remove the straps 48, 50.

Figure 6:
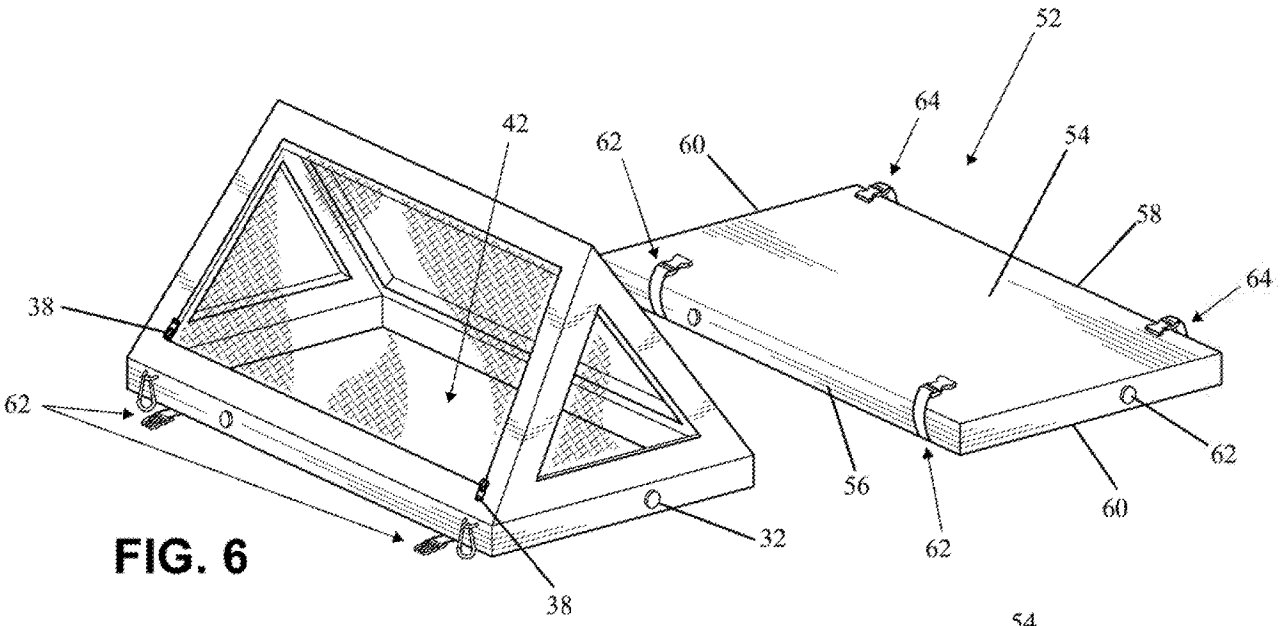
FIG. 6 is a front perspective view of a second version of the invention shown with a removably attachable inflatable bottom mattress.
Figure 7:
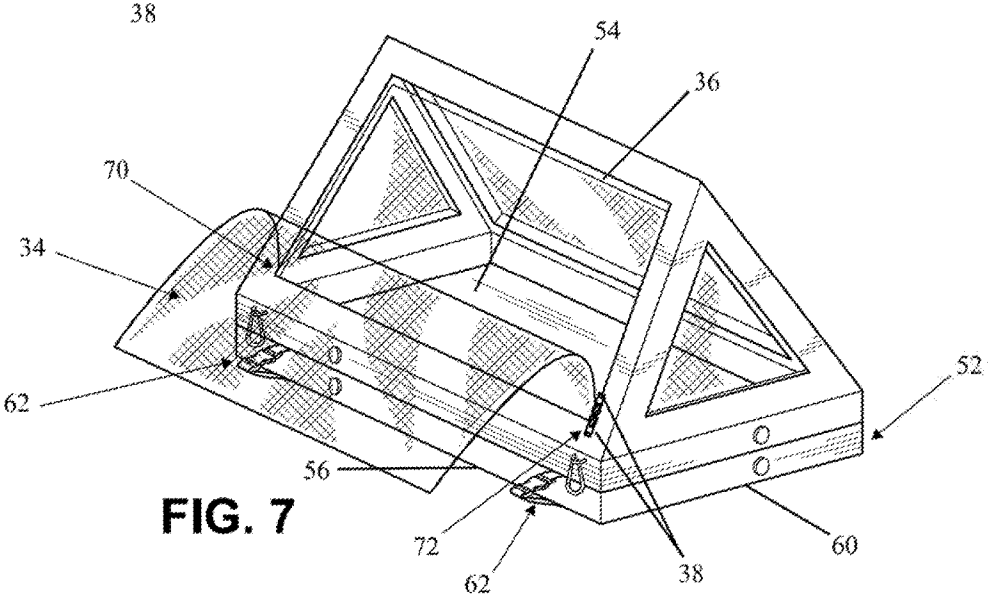
FIG. 7 is a front perspective view of the assembled version show in FIG. 6.
Figure 8:
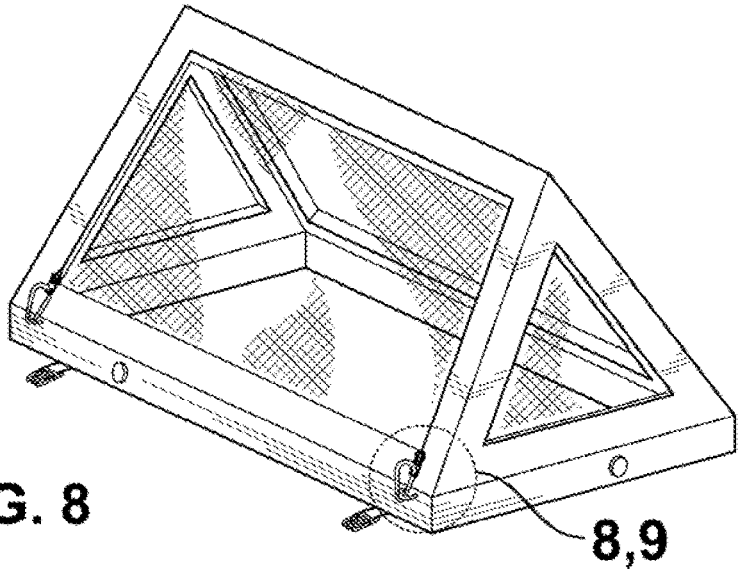
FIG. 8 is front perspective view of the version shown in FIG. 1 while zipper-closable portion is in the closed position.

A second version of the invention will now be described and is best illustrated by FIG. 6 and FIG. 7. The second version generally comprises an upper inflatable structure 12 as described above and an alternate removably attachable inflatable bottom mattress 52. The alternate removably attachable inflatable bottom mattress 52 can be utilized when an existing bedding structure 18 is not available or unwanted. Thus, the inflatable bottom mattress 52 provides a soft, padded floor surface 54 coupled with the floorless bottom 42 and the interior space 20 provided by the upper inflatable structure 12. As best illustrated by FIG. 6, the bottom mattress is generally rectangular in shape comprising a top floor surface 54, a first side 56, a second side 58, and opposing end sides 60 as well as inflation valve 62 for inflation thereof. Ideally, the top floor surface 54 is made of a soft, plush material and is configured to fit the dimensions of the floorless bottom 42 and the bottom rectangular dimensions of the bottom of the upper inflatable structure 12. The bottom mattress 52 can be any thickness that is necessary to adequately support the child's weight and the weight of the upper inflatable structure 12 while inflated.

The bottom mattress 52 is attached to the upper inflatable structure 12 by a means for removably attaching the upper inflatable structure 12 with the inflatable bottom mattress 52. In the illustrated second version and as best illustrated by FIG. 6 and FIG. 7, the means for removably attaching the upper inflatable structure 12 with the inflatable bottom mattress 52 is a pair of removably attachable straps 62 connecting the first wall 22 of the upper inflatable structure 12 with the corresponding first side 56 of the inflatable bottom mattress 52; and a second pair of removably attachable straps 64 connecting the opposing second wall 24 of the upper inflatable structure 12 with the corresponding opposing second side 58 of the inflatable bottom mattress 52, wherein each pair of removably attachable straps 62, 64 are positioned equidistance from the center 66 of each of their corresponding sides, thereby providing improved stability and connection between the upper inflatable structure and the inflatable bottom mattress. The first and second pair of attachable straps 62, 64 may utilize a releasable buckle to attach and detach as shown in FIG. 5 and as described above, thereby easily and quickly attaching or detaching the bottom mattress 52 from the upper inflatable structure 12.

Figure 9:
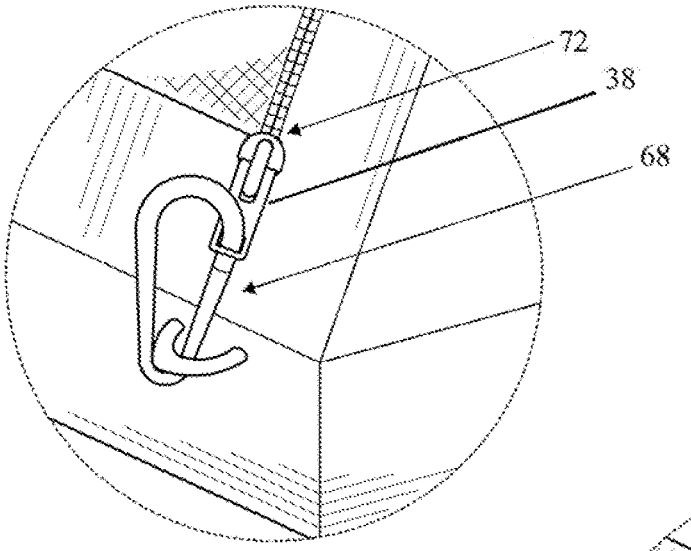
FIG. 9 is an up-close view of the means to secure the zipper in a locked position exterior to the interior space taken from FIG. 8 while the zipper-closable portion is in the open position.
Figure 10:
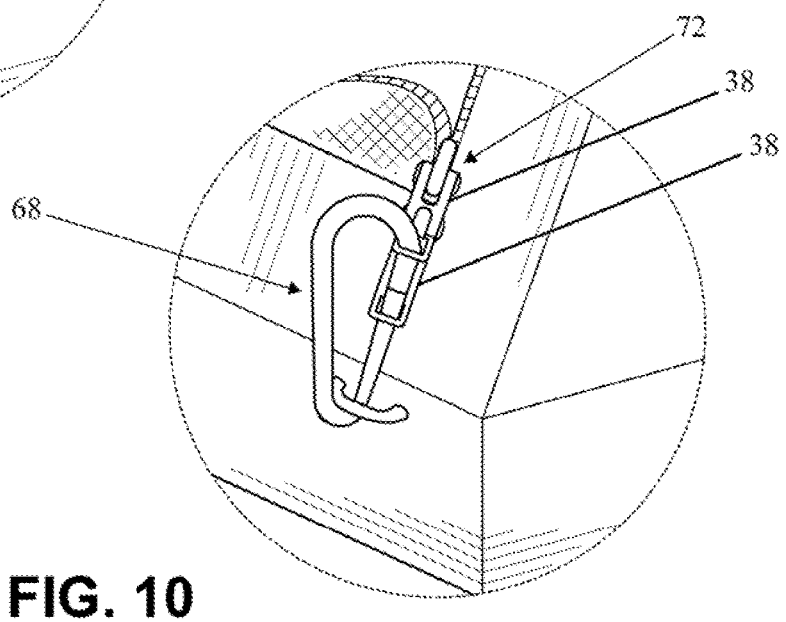
FIG. 10 is an up-close view of the means to secure the zipper in a locked position exterior to the interior space taken from FIG. 8 while the zipper-closable portion is in the closed position.

Optionally, each of the above described version may further include a means for securing the zipper 38 in a locked position located exterior to the interior space when the zipper-closable flap 34 is either in a closed or an open position. In the version as best illustrated by FIG. 9, the means for securing the zipper 38 is a carabiner type clip 68 fixedly attached to the base portion 46 of a wall containing a zipper-closable flap 34. A clip 68 is positioned near both ends of the zipper path of travel 36 in order to lock the zipper 38 while the zipper-closable flap 34 is in the open position (FIG. 10) or in the closed position (FIG. 9). In the illustrated version—the clip 68 is positioned at opposite sides of each side of the first wall 22 near the base portion 46. Providing a means for securing the zipper 38 prevents the child from unzipping and leaving the tent unsupervised as well as prevents a child from entering the tent and securing themselves inside the tent without supervision from the parent or caretaker.

The present invention can be made in any manner and of any material chosen with sound engineering judgment. Preferably, materials will be strong, lightweight, long lasting, economic, and ergonomic. The invention materials may include light weight plastic or composite material with sufficient density to inflate providing air chambers as known in the art, nylon for netting and windows, and other materials such as felt.

The previously described versions of the present invention have many advantages, including providing a unique, light-weight travel friendly bed specifically tailored for special needs children that is stable, fun and safe. The invention opens up new opportunities for parents, caretakers and special needs children to go on the road and travel the world, assured that the special needs child has a safe place for bedding—that is ideal for travel and other situations.

The invention does not require that all the advantageous features be incorporated into every version of the invention.

Although preferred versions of the invention have been described in considerable detail, other versions of the invention are possible.

All the features disclosed in this specification (including and accompanying claims, abstract, and drawings) may be replaced by alternative features serving the same, equivalent or similar purpose unless expressly stated otherwise. Thus, unless stated otherwise, each feature disclosed is one example only of a generic series of equivalent or similar features.

What is claimed is:

1. An inflatable child safety bed assembly adapted to secure to an existing bedding structure having a mattress, comprising:

(a) an upper inflatable structure defining an interior space comprising:

(i) a first wall, a second wall, and opposing end walls when inflated defining a tent having a constant linear triangular cross-section extending between each end, the tent having a floorless bottom and a linear top ridge, wherein each wall includes a base portion; and (ii) wherein at least one of the first wall, second wall, and opposing end walls having a zipper-closable flap having a zipper located at a perimeter thereof which can be opened or closed to provide ingress and egress to the interior space, the zipper-closable flap made of a breathable mesh netting;

(b) at least one removably attachable length adjustable strap connecting the base portion of the first wall and the base portion of the opposing second wall, wherein the length adjustable strap is adapted to secure the upper inflatable structure to an existing bedding structure by extending about the existing bedding structure and connecting with opposite sides of the upper inflatable structure, whereby the length adjustable strap can be adjusted in order to tighten down the upper inflatable structure to the existing bedding structure; and (c) a first means to secure the zipper in a locked position located at the base portion of the first wall adjacent one of the end walls and a second means to secure the zipper in a locked position located at the base portion adjacent to the opposing end wall.

2. The inflatable child safety bed assembly of claim 1, wherein there are two laterally disposed length adjustable straps having a first end and a second end which extend about the mattress body in parallel attaching the base portion of the first wall and the corresponding base portion of the opposing second wall, thereby providing improved stability of the upper inflatable structure while attached to the existing bedding structure.

3. An inflatable child safety bed assembly comprising:

(a) an upper inflatable structure defining an interior space comprising:

(i) a first wall, a second wall, and opposing end walls when inflated defining a tent having a constant linear triangular cross-section extending between each end, the tent having a floorless bottom and a linear top ridge, wherein each wall includes a base portion;

(ii) wherein at least one of the first wall, second wall, and opposing end walls having a zipper-closable flap having a zipper located at a perimeter thereof which can be opened or closed to provide ingress and egress to the interior space, the zipper-closable flap made of a breathable mesh netting; and (iii) a first means to secure the zipper in a locked position located at the base portion of the first wall adjacent one of the end walls and a second means to secure the zipper in a locked position located at the base portion adjacent to the opposing end wall, (b) a removable attachable inflatable bottom mattress adapted to couple with the floorless bottom of the upper inflatable structure in order to provide a flooring to the interior space, the inflatable bottom mattress having a top floor surface, a first side, a second side, opposing end sides, and an inflation valve, wherein the inflatable bottom mattress is separately inflatable; and (c) a means for removably attaching the upper inflatable structure with the inflatable bottom mattress.

4. The inflatable child safety bed assembly of claim 3, wherein the means for removably attaching the upper inflatable structure with the inflatable bottom mattress is a first pair of removably attachable straps connecting the first wall of the upper inflatable structure with the corresponding first side of the inflatable bottom mattress; and a second pair of removable attachable straps connecting the opposing second wall of the upper inflatable structure with a corresponding opposing second side of the inflatable bottom mattress, thereby providing improved stability and connection between the upper inflatable structure and the inflatable bottom mattress.

* * * * *